US012759682B2

(12) United States Patent
Nijhuis et al.

(10) Patent No.: US 12,759,682 B2
(45) Date of Patent: Oct. 13, 2026

(54) SWIMMING AID WITH A TILTABLE BACK FLOAT

(71) Applicant: FIBBY B.V., Rotterdam (NL)

(72) Inventors: Jort Nijhuis, Rotterdam (NL); Hugo Willem Van Der Spek, Rotterdam (NL)

(73) Assignee: FIBBY B.V., Rotterdam (NL)

( * ) Notice: Subject to any disclaimer, the term of this patent is extended or adjusted under 35 U.S.C. 154(b) by 356 days.

(21) Appl. No.: 18/567,684

(22) PCT Filed: Jun. 8, 2022

(86) PCT No.: PCT/NL2022/050313

§ 371 (c)(1),
(2) Date: Dec. 6, 2023

(87) PCT Pub. No.: WO2022/260514

PCT Pub. Date: Dec. 15, 2022

(65) Prior Publication Data

US 2024/0278886 A1 Aug. 22, 2024

(30) Foreign Application Priority Data

Jun. 8, 2021 (NL) ..... 2028409

(51) Int. Cl.
*B63C 9/11* (2006.01)

(52) U.S. Cl.
CPC ..... *B63C 9/11* (2013.01)

(58) Field of Classification Search
CPC ..... B63C 9/11
See application file for complete search history.

(56) References Cited

U.S. PATENT DOCUMENTS 3,903,555 A * 9/1975 Busby ..... B63C 9/1255 441/116
5,030,153 A 7/1991 Bailey
(Continued)

FOREIGN PATENT DOCUMENTS

DE 920049 C 11/1954
FR 1380334 A 11/1964
(Continued)

OTHER PUBLICATIONS

PCT International Search Report and Written Opinion dated Oct. 11, 2022, for International Application No. PCT/NL2022/050313.
(Continued)

*Primary Examiner* — Jess Whittington
(74) *Attorney, Agent, or Firm* — Patterson + Sheridan, LLP

(57) ABSTRACT

A swimming aid being configured to increase a user's buoyancy in the water. The swimming aid has a supporting structure with a back float. The supporting structure is designed to secure the swimming aid to a user's upper body. The back float is tiltable—seen in use—about a transverse axis connected to the supporting structure. The tilting movement of the back float to the supporting structure enables the user to obtain an inclined, more vertical posture in the water, which will improve the user's ability to keep their head above the surface of the water and also intuitively encourages the user to stretch out their hands to make a supportive movement with the hands in the water. Thus, the swimming aid increases water safety and at the same time promotes swimming skills.

24 Claims, 4 Drawing Sheets

(56) References Cited

U.S. PATENT DOCUMENTS

| | | | | |
|---|---|---|---|---|
| 5,746,633 | A * | 5/1998 | Jeffrey | B63C 9/1255 441/123 |
| 5,766,114 | A * | 6/1998 | Campbell | A47D 13/025 441/116 |
| 6,312,054 | B1 * | 11/2001 | Scheurer | A47C 15/006 441/130 |
| 6,346,021 | B1 * | 2/2002 | Masse | A63B 31/11 441/64 |
| 6,527,605 | B1 * | 3/2003 | Charte | B63C 9/00 441/7 |
| 6,537,119 | B2 * | 3/2003 | Deslauriers | B63C 9/115 441/106 |
| 9,573,073 | B1 * | 2/2017 | Mazur | A63H 33/004 |
| 2011/0165805 | A1 | 7/2011 | Berry | |
| 2014/0087611 | A1 * | 3/2014 | Hsu | B63C 9/115 441/115 |
| 2017/0006932 | A1 * | 1/2017 | Quaglia | B63C 9/087 |
| 2018/0237115 | A1 * | 8/2018 | Duff | B63C 9/115 |
| 2019/0282858 | A1 * | 9/2019 | Harkins | B63C 9/115 |
| 2022/0402580 | A1 * | 12/2022 | Masi | B63C 9/30 |

FOREIGN PATENT DOCUMENTS

| | | | |
|---|---|---|---|
| KR | 20090009381 | U | 9/2009 |
| SE | 19484 | C1 | 6/1905 |
| WO | 9716223 | A1 | 5/1997 |
| WO | 2011051993 | A1 | 5/2011 |
| WO | 2018096336 | A1 | 5/2018 |

OTHER PUBLICATIONS

Netherlands Search Report and Written Opinion dated Nov. 24, 2021, for Netherlands Patent Application No. 2028409.

* cited by examiner

SWIMMING AID WITH A TILTABLE BACK FLOAT

CROSS-REFERENCE TO RELATED APPLICATIONS

This application is a U.S. national phase filing of International Application No. PCT/NL2022/050313, filed Jun. 8, 2022, which claims priority to and the benefit of Netherlands Application No. 2028409, filed Jun. 8, 2021, each of which is herein incorporated by reference in its entirety.

BACKGROUND OF THE INVENTION

Field of the Invention

This invention relates to a swimming aid with a supporting structure provided with a float, wherein the float is to be worn on the back during use, a so-called back float.

Description of the Related Art

Several such state of the art swimming aids are known.

SE19484C1 shows a swimming aid with publication dated 3 Jun. 1905. The swimming aid is provided with a float. The float is arranged to be worn on the back of a swimmer. Using an upper strap and a lower strap, a swimmer can secure the swimming aid to the upper body and wear the float on the back.

As the float is worn on the back, the swimming aid ensures that the swimmer is positioned on their stomach in the water. A problem with this well-known swimming aid is that it does not provide enough safety, particularly for small children.

US2011165805 shows another swimming aid that is designed to be worn by children. The swimming aid comprises a belt to be worn around a child's torso. Attached to the belt are a left and right inflatable float. These floats have armholes for the child's arms.

Compared to the above-mentioned swimming aid, this well-known swimming aid provides improved safety for children. However, a disadvantage of this swimming aid is that it is unsuitable for learning a swimming stroke.

WO11051993 shows a swimming aid in which a back float is fitted with a harness, with which the float can be worn on the back of a child. The harness has two shoulder straps, a cross strap, an inflatable waist strap and a groin strap for attachment between the legs.

The swimming aid is designed to hold the child in a horizontal position rather than in a more vertical one. This is intended to enable a child to learn the basic movements needed to learn to swim more quickly.

KR20090009381 shows a swimming aid with a similar harness fitted with a back float. The harness has shoulder straps, a waist strap and a groin strap. The back float is connected to the harness by a mechanism with adjustable height, allowing a swimmer to assume different positions in the water. With the back float up, the swimmer is held in a more vertical position, while when the float is positioned down, the swimmer is held in a more horizontal position. The disadvantage of this swimming aid is that it is not very safe.

The present invention aims to overcome at least one of the above-mentioned disadvantages, at least partially, or to provide a useful alternative. In particular, it is a purpose of the invention to provide a swimming aid with a back float that provides water safety in the event of a person falling into the water, and which is suitable for teaching children a swimming skill, in particular, to be able to move around in the water.

SUMMARY

This objective is achieved by a swimming aid according to the invention. The swimming aid has a supporting structure with a float intended to provide additional buoyancy to a user. The swimming aid is worn on the upper body of the user using the supporting structure. The float is connected to the supporting structure in such a way that when the user puts on the supporting structure, the float is positioned on the back. Since the float of the swimming aid is intended to be worn on the user's back, the float is called a back float.

The swimming aid has a longitudinal axis corresponding to the longitudinal axis of the user. A feature of the swimming aid according to the invention is that the back float can make a tilting movement in relation to the supporting structure. The back float—seen in use—is tiltable about a transverse axis connected to the supporting structure, wherein a tilting movement of the back float to the supporting structure is limited to a sharp tilting angle $\alpha$ in between the supporting structure and the back float of at most 45°. The transverse axis extends in parallel with an imaginary axis through the left and right armholes of the supporting structure. The transverse axis of the swimming aid is therefore an axis parallel to the transverse axis of the user.

The tilting movement of the back float in relation to the supporting structure allows the user to obtain an inclined, more vertical posture in the water, which will improve the user's ability to keep their head above the surface of the water, and also intuitively encourages the user to stretch out their hands in front of them to make a supportive movement in the water, particularly a crawl. The angled, more vertical posture, in which the head is more easily held above the water, provides a favourable water-safe position. At the same time, the slightly angled position promotes a basic swimming skill, wherein a forward movement is made in the water. Thus, the swimming aid increases water safety and at the same time promotes swimming skills.

The tilting movement of the back float to the supporting structure makes the swimming aid very suitable for developing a swimming skill. Preferably, the tilting movement of the back float to the supporting structure is limited to a sharp tilting angle of no more than 45°, the sharp tilting angle being between the back float and the rear side of the supporting structure. In particular, the tilting angle shall not be less than 15° and more specifically no less than 30°.

In one embodiment of the swimming aid according to the invention, the transverse axis for the tilting movement is positioned at the level of an armhole of the supporting structure. The transverse axis is substantially positioned at the level of a central axis through the arm openings of the supporting structure. This means that the transverse axis is positioned at the level of the shoulder blades of a user when wearing the swimming aid.

In one embodiment of the swimming aid according to the invention, the back float is connected to the supporting structure using an upper attachment and, in particular, a lower attachment. Upper and lower attachment refers here to a usage situation of the swimming aid. The upper attachment to the supporting structure is positioned at the height of the user's shoulder blades and the lower attachment to the supporting structure is positioned at a distance below. On the swimming aid itself, the upper attachment is positioned at an armhole of the supporting structure.

The upper attachment enables the back float to move in a substantially tilting direction relative to the supporting structure. As a result, the swimming aid enables a user to assume a more vertical posture in the water, and in particular, a posture in relation to a pure vertical one at an angle of at most 45°, and in particular of at most 30°. In other words, compared to a horizontal position, the user's feet sink deeper, giving the user a more upright posture in the water.

In one embodiment of the swimming aid according to the invention, the upper attachment of the back float comprises a left and a right float attachment that connects to the left and right portion of the back float, respectively. A left and a right float attachment contribute to stable positioning of the back float.

In an alternative embodiment of the swimming aid according to the invention, the upper attachment of the back float is positioned centrally on the rear side of the supporting structure. The centrally positioned upper attachment may be positioned on or near an edge of the neck opening of the supporting structure.

In one embodiment of the swimming aid according to the invention, the upper attachment of the back float is made of a flexible line element. A flexible line element is, for example, a fabric strip, preferably a neoprene tape material, or a cord. An intermediate distance between the back float and the supporting structure should preferably be no more than 2 cm. The line element with a limited length, for example 2 cm at most, ensures that an upper portion of the back float remains positioned to the supporting structure, but allows a tilt of the back float such that a lower portion of the back float can move away from the supporting structure.

In one embodiment of the swimming aid according to the invention, the upper attachment has a V-shape. The legs of the V-shaped attachment are connected to the supporting structure. A top of the V-shaped attachment is connected to the back float. The connection to the back float should preferably be line-shaped. The line-shaped connection limits the tilting angle of the back float to the supporting structure. The line-shaped connection may be obtained by folding a flexible line element, for example, a strip of fabric, through an elongated slot of the back float. By moving the folded line element, it is advantageous to set a tilting angle of the back float to the supporting structure. In a variant, the line-shaped connection may also be provided by a linking element connecting the left and right sections of the attachment and extending through a continuous hole of the back float.

In one embodiment of the swimming aid according to the invention, a lower attachment is provided to the back float. The lower attachment restrains a movement of the back float away from the supporting structure over a predetermined distance. In combination, the upper and lower attachments ensure that the back float is positioned in the water at an inclined angle to the supporting structure.

In one embodiment of the swimming aid according to the invention, the lower attachment is positioned at the level of a lower edge of the supporting structure. Preferably, the bending movement delimiting the lower attachment is possible over a predetermined distance of at least 10 cm, in particular at least 15 cm. Preferably, the predetermined distance of the bending movement is determined by an end stop. Preferably, the end stop is made of a flexible line element, such as a strip of fabric or a cord.

In one embodiment of the swimming aid according to the invention, the predetermined distance of the lower attachment of the back float is adjustable. As a result, the distance over which the back float can incline to a user's back is adjustable. This has the advantage that a tilting angle of the back float can make in relation to the supporting structure can be adjusted differently dependent on the progress of a swimmer in the learning process of a swimming skill.

In one embodiment of the swimming aid according to the invention, the back float is made of an injection-moulded product. The back float may be made of foam material, or an EVA or EPP plastic material. Alternatively, the back float could be an inflatable product, but a solid back float is preferred because the solid material contributes to the safety of the swimming aid by keeping the buoyancy available at all times in all conceivable situations.

In one embodiment of the swimming aid according to the invention, the supporting structure constitutes a vest. The vest should preferably be made of neoprene material. The vest has a back section, a left and a right armhole and a clasp on a chest section of the vest. To wear the swimming aid, the user's arms are to be inserted through the left and right armholes, after which the clasp is to be fastened. The shape of the armholes should preferably fit closely around the user's arms. The armholes may have a circular shape. This ensures that there is little or no upward movement of the supporting structure during the use of the swimming aid.

In one embodiment of the swimming aid according to the invention, the supporting structure constitutes a harness, in particular a harness made of straps. The harness is provided with a left and a right shoulder strap. The harness has a chest piece for clasping the left and right shoulder straps. The chest pieces can be connected or fixed to the left and right shoulder strap. The chest piece, together with the left and right shoulder strap, forms the neck opening of the harness. When the chest piece is firmly connected to the left and right shoulder straps, the harness must be pulled over the user's head to wear the harness on the upper body.

In a further embodiment, the harness includes a chest strap. When the harness is fitted on the upper body, the chest strap extends down the arms of the user around the chest. The chest strap can be fastened by a chest strap clasp. Together with the left and right shoulder straps, the chest strap forms the left and right armholes respectively, for encircling a user's arm. Preferably, the chest strap is configured to engage with a lower portion of the rib cage, thereby preventing the harness from sliding upwards. This prevents the harness from sliding upward in a longitudinal direction relative to the user's upper body, if at all, which could cause a user to sink too deeply into the water.

In a further or alternative embodiment, the harness includes a groin strap for clasping the harness along a user's groin. The harness can be fastened to the user's upper body using the groin strap in combination with the shoulder straps in a vertical direction. In this way, the groin strap contributes to the safety of the swimming aid.

Furthermore, the invention relates to the use of the swimming aid according to the invention in a teaching method for improving a swimming skill. The teaching method may comprise, for example, visual instructions. The visual instructions are preferably provided using an application for a computer device, such as a smartphone. The application may comprise a smartphone application. The smartphone application may comprise video instructions, wherein different steps in the use of the swimming aid for improving a swimming skill are explained step by step, depending on the progress of swimming students. In a step of a teaching method, an instruction may be provided for a restriction of a tilting movement of the back float to the supporting structure.

BRIEF DESCRIPTION OF THE DRAWINGS

The invention will be further explained in the appended drawings. The drawings constitute a practical embodiment of the invention, which may not be considered in a restrictive sense. Specific detailed features may also be regarded as characteristic of the invention in a general sense, independently of the implementation example, in which.

DETAILED DESCRIPTION

Identical reference numbers have been used in the figures to denote corresponding parts. In order to facilitate an understanding of the description and the claims, the words 'under, over, vertical, horizontal, longitudinal, transverse, central' have been used with reference to gravity, the human body and normal use of the swimming aid, which words are to be interpreted as technically functional and not limiting the scope of protection.

Figure 1:
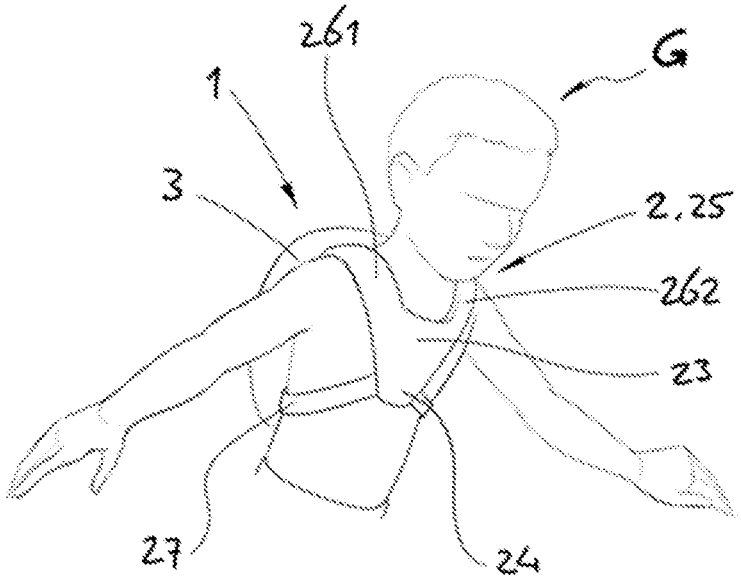
FIG. 1 shows a user wearing a swimming aid according to the invention.

FIG. 1 shows a user G, a child, with a swimming aid 1 according to the invention. The swimming aid has a carrying structure 2. Here, the supporting structure constitutes a harness 25. The harness 25 is designed to be worn on the upper body of the user. The harness 25 has a left and right shoulder strap 261, 262. The shoulder straps 26 are securely connected at a chest area 23, providing a neck opening. By inserting the head through the neck opening, the user can apply the harness 25 to the upper body. The harness can be fastened using a chest strap 27 and a clasp 24. The harness has a back section 22. A back float 3 is attached to the back section. The back float 3 may be inflatable but has a solid form here.

Figure 2:
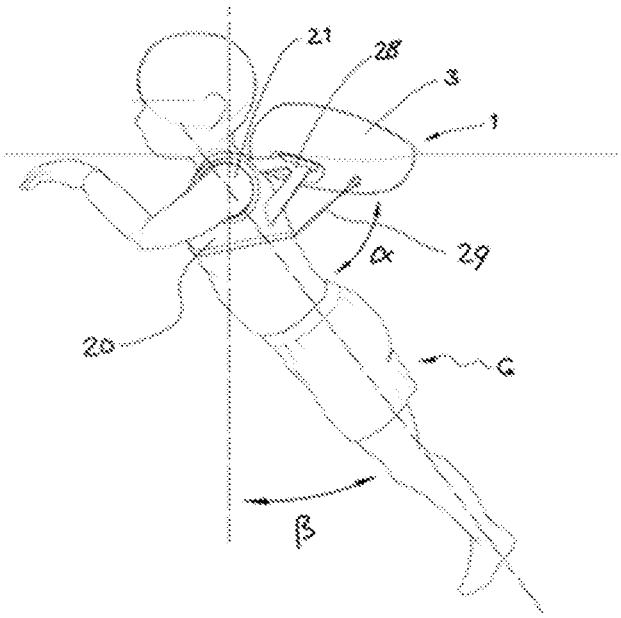
FIG. 2 shows the user in the water from a side view, where a back float of the swimming aid is tilted away from a supporting structure by buoyancy

FIG. 2 shows a user with an alternative embodiment of the swimming aid 1 in the water. Here, the supporting structure is designed as a vest 20. The vest fits closely to the upper body of the user G. The vest is made of a stretchable material. The vest should preferably made of neoprene. The vest has a left and a right armhole 21. The armhole 21 has a circular shape. The armhole 21 is designed to fit closely to the upper arm of the user G. As a result, the vest 20 is securely in place in position to the upper body of the user G. When the user is in the water, in which a buoyant force acts on the vest 20 via the back float 3, the vest 20 remains in place on the body of the user without moving upward impermissibly.

Figure 5:
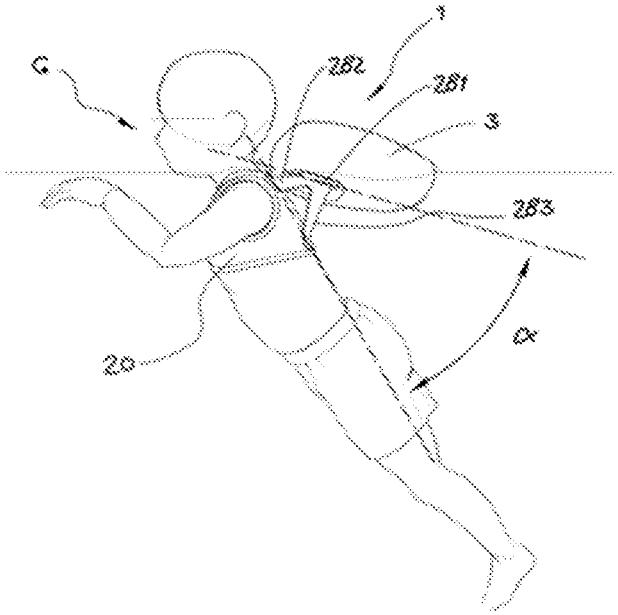
FIG. 5 shows a user with the swimming aid according to the invention, wherein only an upper attachment to the back float is provided.

As shown in FIG. 2, the back float 3 is connected to the vest 20 by an upper attachment 28 and a lower attachment 29. However, as shown in FIG. 5, the swimming aid 1 may also be constructed with only an upper attachment 28 to an upper portion of the back float and without the lower attachment 29.

In FIG. 2, the upper attachment 28 is connected to an upper portion of the vest 20. The upper attachment 28 is positioned at the level of the arm opening 21. This positions the upper attachment 28 at the level of a shoulder blade of the user G. The upper attachment 28 is connected to an upper portion of the back float 3.

The bottom edge of the vest 20 is provided with the lower attachment 29. The lower attachment 29 is made of a strip of fabric. One end of the fabric strip is connected to the vest 20 and the other end of the strip of fabric is connected to the back float 3. The lower attachment 29 is connected to the back float at a position below the upper attachment 28. Here, the lower attachment 29 is connected to a lower portion of the back float 3.

The lower attachment 29 limits the tilting angle $\alpha$ of the back float 3 in relation to the supporting structure 2 allowed by the upper attachment 28. The lower attachment 29 accurately secures the tilting angle $\alpha$ of the back float 3.

As shown in FIG. 2, swimming aid 1 allows a more vertical posture for the user in the water. User G has a slanted, more vertical posture at an angle $\beta$ of, for example, 30° in relation to a purely vertical one. This more vertical posture places the user in a posture that benefits acquiring a swimming skill to move in the water.

Figure 3:
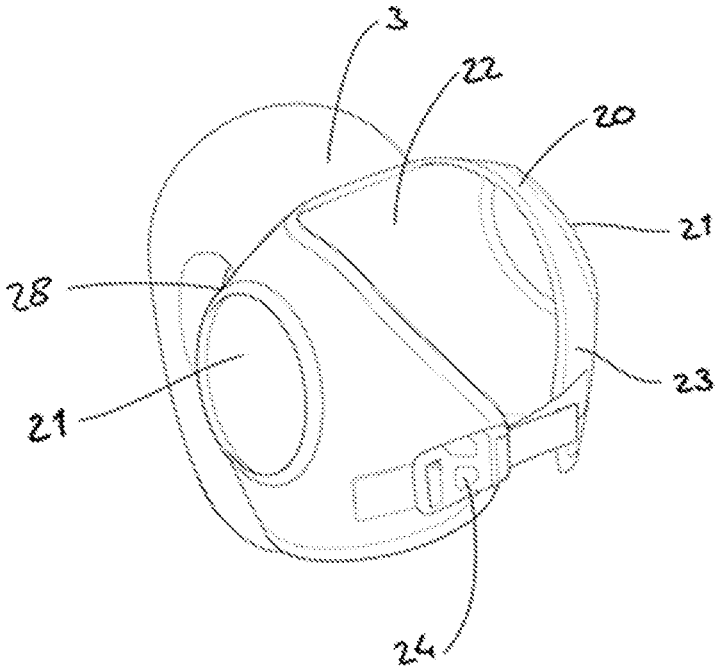
FIG. 3 shows a perspective view the supporting structure in the form of a vest.
Figure 4:
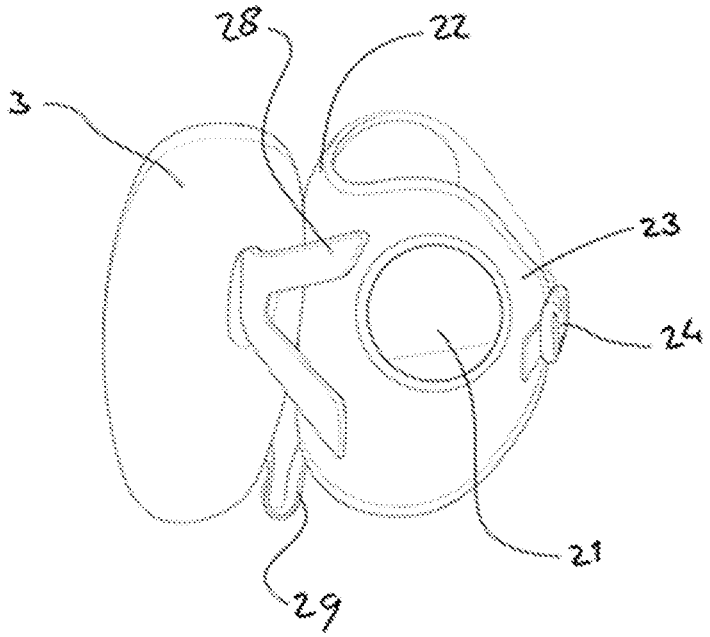
FIG. 4 shows the swimming aid from FIG. 3 from a side view.

FIG. 3 shows the vest 20 in more detail from a perspective view, with FIG. 4 showing the vest 20 from a side view. The vest 20 has a back section 22, armholes 21 and a chest section 23. A clasp 24 is provided on the chest section 23. A back float 3 is attached to the back section 22 by an upper attachment 28. The upper attachment 28 has a left section and a right section, between which the back float 3 is attached. The lower attachment 29 is positioned centrally on the back section 22. Here, the lower attachment 29 is made of a fabric strip, but may also be made of neoprene.

Figure 6:
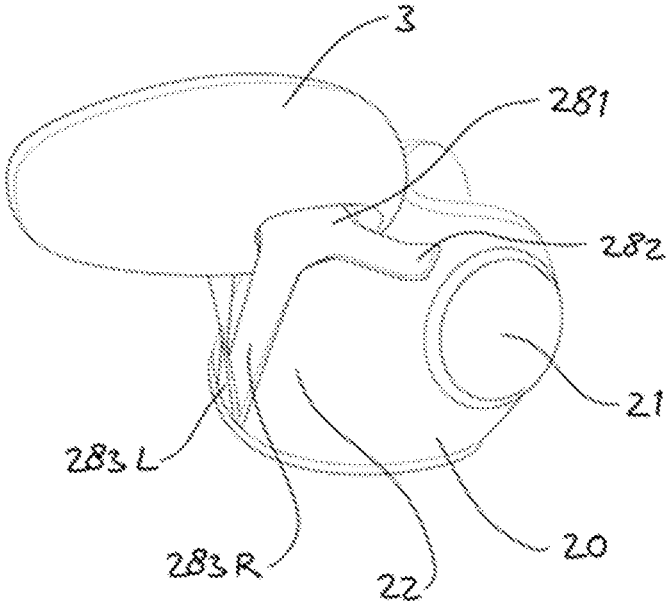
FIG. 6 shows a perspective view of the swimming aid from FIG. 5, viewed from below.

FIGS. 5 and 6 show, as indicated briefly above with regard to FIG. 2, an embodiment of the swimming aid 1, which lacks a lower attachment 29. It allows a tilting movement of the back float 3, limited to a maximum tilting angle $\alpha$ by attachment 28 of the back float 3 to the supporting structure 20.

The attachment 28 of the back float 3 to the supporting structure 2 has a V-shape. The V-shape has a first and a second V-leg 282, 283 and a V-top 281. The first and second V-legs are attached to the vest 20 one below the other. The V-top is attached to the back float 3. The attachment of the V-top is—viewed in a longitudinal section—a line connection. The line connection here is substantially parallel to a longitudinal direction of the back float. The orientation of this line connection provides an orientation of the back float 3 to the vest 20 at a certain tilting angle $\alpha$ in the water.

The V-shaped attachment 28 may be achieved by an obliquely folded strip of fabric. The fold of the strip forms a line of the line connection. The strip may be looped through a slot on the back float 3. By extending one V-leg to the other V-leg, the desired tilting angle $\alpha$ of the back float can be set.

FIG. 6 shows a perspective view of the swimming aid where the back float 3 is provided with a through-hole. The through-hole extends from the left side to the right side of the back float 3.

Here, the attachment is made of neoprene. The attachment may be made from a cut-out from neoprene sheet material. The attachment on the back float 3 to the vest 20 has a V-shaped left section and a V-shaped right section. The ends of the first two V-legs are connected to the vest at the level of the armholes 21. The ends of the two-second V-legs 283L, 283R of the left and right sections of the attachment 28 may coincide at a central position on the back portion 22 of the vest 20.

A bridging piece connects the left and right sections. The bridging piece extends through the through-hole of the back float 3. Due to the V-shape of the left and right sections, the back float 3 is locked in a lateral direction, such that the back float 3 is stably positioned on a user's back.

Figure 7:
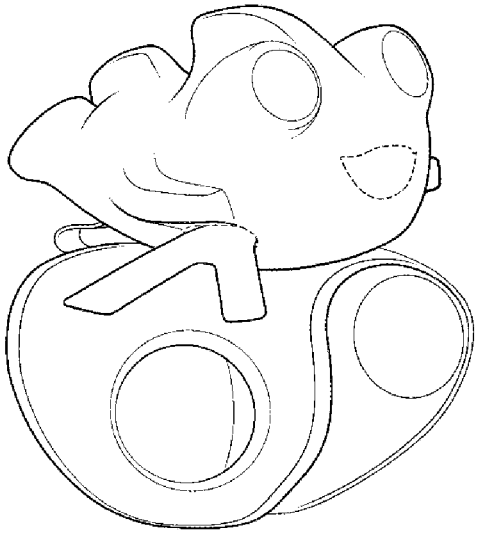
FIG. 7 shows a perspective view of a child-friendly swimming aid.

Various designs of the back float are conceivable. Preferably, a design is obtained from a solid plastic material, in particular a foam material. FIG. 7 shows an embodiment of the swimming aid in which the back float has a child-friendly design.

The back float is shaped like an amphibious creature. The amphibious creature has big eyes like a frog and short legs. By adapting the shape of the back float to suit a child's perception of the world, the swimming aid is attractive for use by children. Children will regard the swimming aid as a buddy to take into the water. This further contributes to increasing the safety of the swimming aid.

In addition to the embodiments shown in the figures, many variations are possible. In one variation of the depicted embodiment of the vest, a supporting structure may be obtained in the form of a harness. In a variation of the shown embodiment of the V-shaped fastening using an obliquely folded strip of fabric, a fastening may be formed from a piece of plastic material. The back float may be solid or inflatable.

The invention has been presented with reference to the embodiment of the swimming aid according to the invention. It is emphasised that after reading the description, a person skilled in the art may wish to make changes or adaptations which are technically possible but which will not fall outside the scope of protection of the invention as defined in the accompanying claims. The person skilled in the art should understand that various adaptations can be made from a technical point of view and that elements can be replaced by equivalents without departing from the essence of the invention. In particular, within the definition according to the appended claims, modifications may be made to the embodiments shown which do not depart from the essence of the invention and thus remain within the scope of the invention.

It should be noted that aspects according to the invention and, in particular, aspects mentioned in the dependent claims, are considered patentable on their own merits independently of aspects of the other claims. These aspects may, for example, become the subject of divisional Patent applications, with these aspects being defined independently of the aspects currently included in the independent claims or other dependent claims.

Thus, the invention is not limited to the shown and described embodiments, but the scope of protection of the invention will cover all embodiments that fall within the definition of the appended claims.

Reference signs list:

| G user | |
|---|---|
| 1 | swimming aid |
| 2 | supporting structure |
| 3 | back float |
| 20 | vest |
| 21 | armhole |
| 22 | back section |
| 23 | chest section |
| 24 | clasp |
| 25 | harness |
| 26 | shoulder strap |
| 27 | chest strap |

-continued

Reference signs list:

| G user | |
|---|---|
| 28 | top attachment |
| 280 | V-shaped attachment |
| 281 | line connection; V-top |
| 282 | V-leg |
| 283 | V-leg |
| 29 | lower attachment |

The invention claimed is:

1. A swimming aid which is arranged to increase a user's buoyancy in the water, wherein the swimming aid comprises a supporting structure with a back float, wherein the supporting structure is configured to secure the swimming aid to a user's upper body, wherein the back float is tiltable about a transverse axis connected to the supporting structure, wherein a tilting movement of the back float to the supporting structure is limited to a tilting angle $\alpha$ in between the supporting structure and the back float of at most 45°.

2. The swimming aid according to claim 1, wherein the transverse axis for a tilting movement of the back float is positioned substantially at a level of an armhole of the supporting structure.

3. The swimming aid according to claim 1, wherein the back float is connected to the supporting structure by an upper attachment of the back float, the upper attachment substantially allows the back float to be tilted relative to the supporting structure.

4. The swimming aid according to claim 3, wherein the upper attachment is positioned at the level of an armhole of the supporting structure.

5. The swimming aid according to claim 3, wherein the upper attachment of the back float comprises a left and a right float attachment.

6. The swimming aid according to claim 3, wherein the upper attachment of the back float is positioned centrally on the rear side of the supporting structure.

7. The swimming aid according to claim 3, wherein the upper attachment of the back float is made from a flexible line element, wherein the line element allows a tilting movement of the back float.

8. The swimming aid according to claim 7, wherein the line element has a length of at most 2 cm to allow that when the back float is floating, this results in a substantially tilting movement of the back float to the supporting structure.

9. The swimming aid according to claim 7, wherein the upper attachment is V-shaped, wherein the legs of the V-shaped attachment are connected to the supporting structure and the top of the V-shaped attachment is connected to the back float, wherein the connection to the back float is a line connection to allow that the V-shaped attachment provides a limitation of a tilting angle $\alpha$ of the back float to the supporting structure.

10. The swimming device according to claim 1, further comprising a lower attachment to the back float, the lower attachment limiting a movement of the back float away from the supporting structure over a pre-determined distance such that the back float becomes positioned in the water at a tilted angle $\alpha$ relative to the supporting structure.

11. The swimming aid according to claim 10, wherein the lower attachment is positioned at the level of a bottom edge of the supporting structure.

12. The swimming aid according to claim 10, wherein the diverging movement limiting the lower attachment is possible over a predetermined distance of at least 10 cm.

13. The swimming aid according to claim 12, wherein the predetermined distance of the diverging movement of the back float is determined by an end stop.

14. The swimming aid according to claim 13, wherein the end stop is made from a flexible line element, such as a cord or strip of neoprene.

15. The swimming aid according to claim 12, wherein the predetermined distance of the lower attachment of the back float is adjustable to allow that a tilted angle $\alpha$ is adjustable to allow the back float to rotate relative to the supporting structure.

16. The swimming aid according to claim 1, wherein the back float is an injection-moulded product.

17. The swimming aid according to claim 1, wherein the supporting structure constitutes a vest.

18. The swimming aid according to claim 17, wherein the vest has a left and a right armhole for accommodating a left and a right arm of the user, respectively, and wherein a vest clasp is provided on a chest section of the vest.

19. The swimming aid according to claim 1, wherein the supporting structure of the swimming aid constitutes a harness, wherein the harness is provided with a left and right shoulder strap and has a chest section for fastening the left and right shoulder strap.

20. The swimming aid according to claim 19, wherein the chest section is fixated to the left and right shoulder straps in such a way that a neck opening is formed through which a user's head can be inserted for putting on the swimming aid.

21. The swimming aid according to claim 19, wherein the harness is further provided with a chest strap for clasping the harness around a chest of a user, wherein the chest section particularly comprises a chest clasp for fastening and unfastening the chest strap.

22. The swimming aid according to claim 21, wherein the chest strap together with the left and right shoulder straps form a left and right armhole for enclosing an arm of the user, wherein the chest strap is designed to engage with a lower portion of the rib cage of the user.

23. The swimming aid according to claim 19, wherein the harness comprises a groin strap for enclosing an upper body of a user together with the left and right shoulder straps.

24. The swimming aid according to claim 1, wherein the back float is connected to the supporting structure by an upper attachment of the back float, the upper attachment substantially allows the back float to be tilted relative to the supporting structure, wherein the upper attachment of the back float is made from a flexible line element, wherein the line element allows a tilting movement of the back float, wherein the upper attachment is V-shaped, wherein the legs of the V-shaped attachment are connected to the supporting structure and the top of the V-shaped attachment is connected to the back float, wherein the connection to the back float is a line connection to allow that the V-shaped attachment provides a limitation of the tilting angle $\alpha$ of the back float to the supporting structure.

* * * * *